United States Patent [19]

Peterson

[11] 4,288,027

[45] Sep. 8, 1981

[54] OPENABLE CARDBOARD LID FOR EXTENDABLE POPCORN PANS

[75] Inventor: David S. Peterson, Oak Lawn, Ill.

[73] Assignee: Champion International Corporation, Stamford, Conn.

[21] Appl. No.: 77,382

[22] Filed: Sep. 20, 1979

[51] Int. Cl.[3] ..... B65D 5/64; B65D 5/70

[52] U.S. Cl. ..... 229/43; 206/628

[58] Field of Search ..... 229/43, 3.5 MF; 206/628; D9/253, 254, 281

[56] References Cited

U.S. PATENT DOCUMENTS

| | | | |
|---|---|---|---|
| 3,144,194 | 8/1964 | Cartwright | 229/43 |
| 3,244,356 | 4/1966 | Wolowicz et al. | 229/43 |
| 3,391,852 | 7/1968 | Waldrop | 229/43 |
| 3,425,845 | 2/1969 | Dunn | 229/43 |
| 4,194,680 | 3/1980 | Scott et al. | 229/43 |
| 4,194,681 | 3/1980 | Scott et al. | 229/43 |
| 4,211,360 | 7/1980 | Scott et al. | 229/43 |

*Primary Examiner*—Stephen P. Garbe

*Attorney, Agent, or Firm*—Evelyn M. Sommer

[57] ABSTRACT

An openable lid for covering a popcorn pan provided with an expandable top foil, comprises an opening device in the form of two circular score lines cooperating with an angular pull tab and having a protective satellite tab of a semi-circular shape with a base line integral with a circumferential section of the lid, a row of through-cuts extending along the base line and two parallel rows of through-cuts arranged to match the score lines of the opening device when the protective tab is folded-over against the bottom surface of the lid. To prevent an accidental breakage of the extendable aluminum foil bag due to the resistance of the protective tab against bending, the upper row of through-cuts is provided with lateral arcuate through-cuts bridging the lateral edges of the tab and the terminal through-cut lines in the upper row. In addition, the base line is reduced in length by cutting out in the base region lateral notches. Similar V-shaped notches can be also provided in the range of the upper row of the through-cuts.

3 Claims, 8 Drawing Figures

FIG. 3
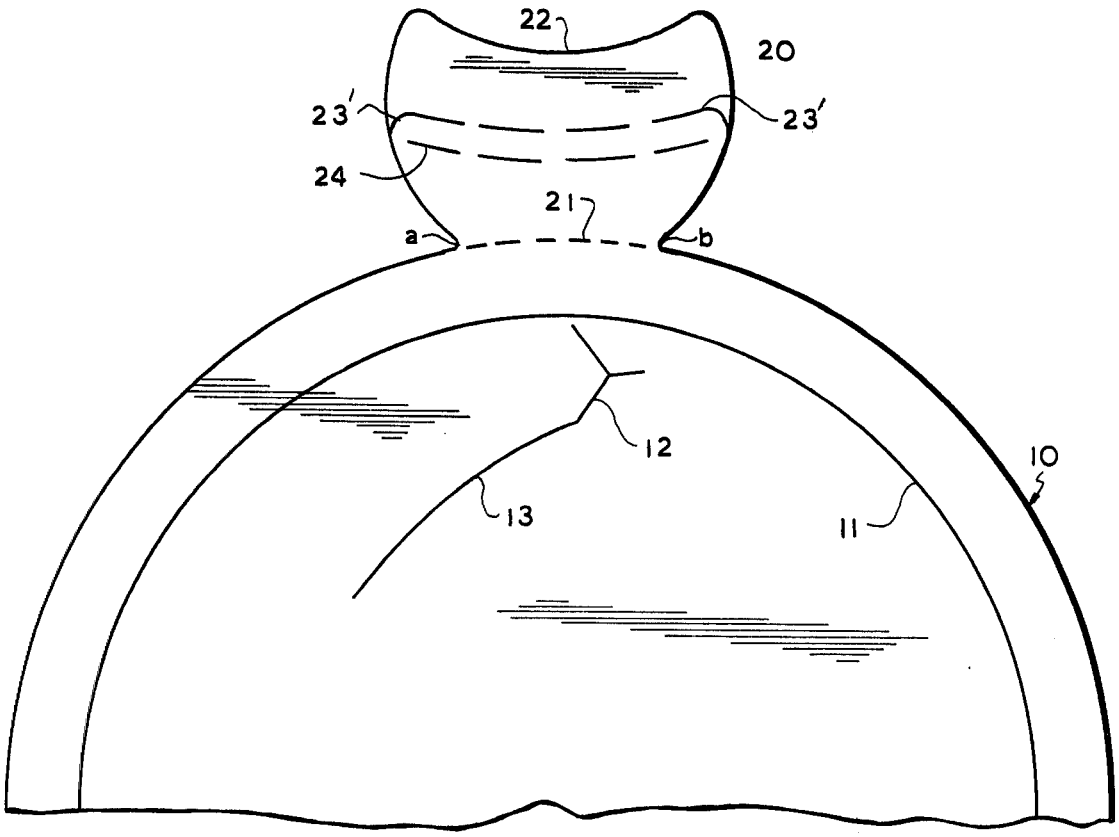
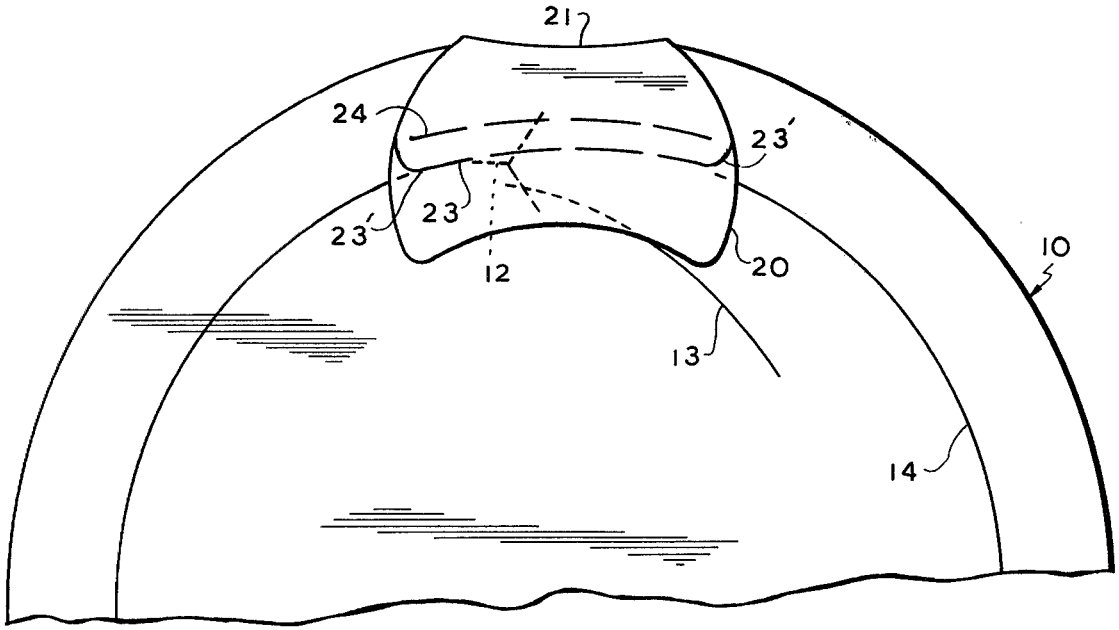
FIG. 4

FIG. 5
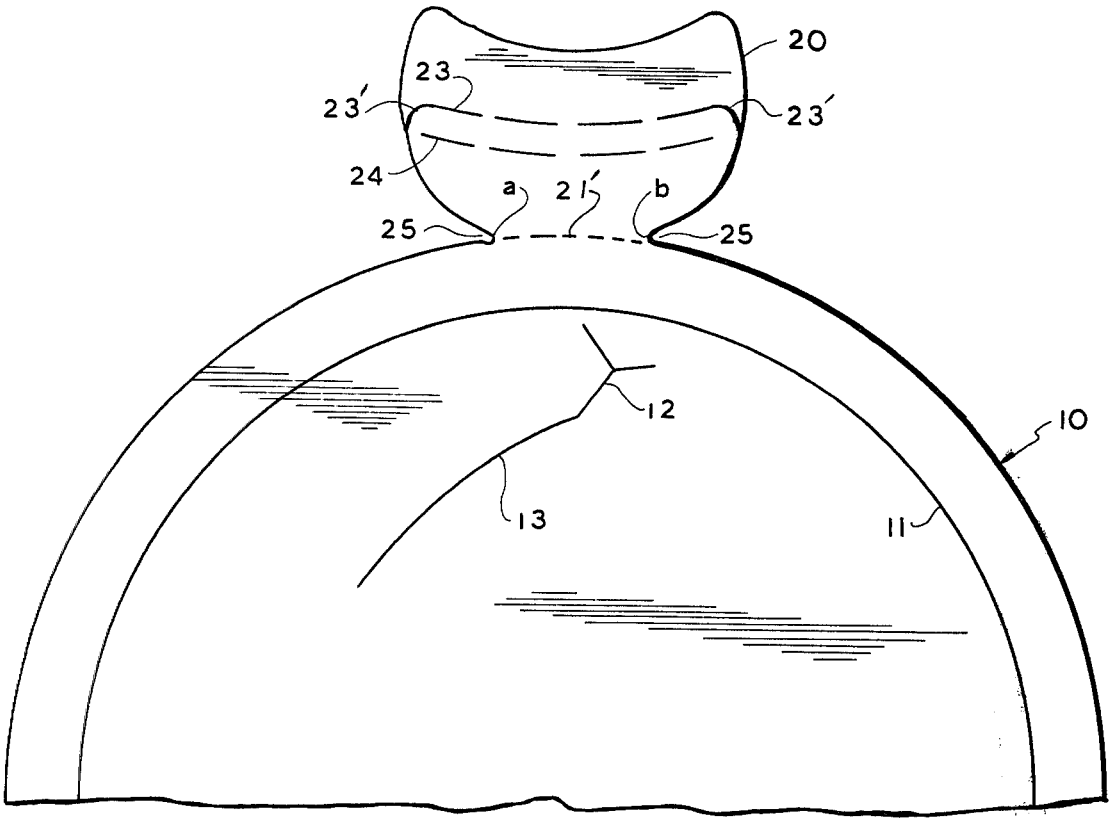
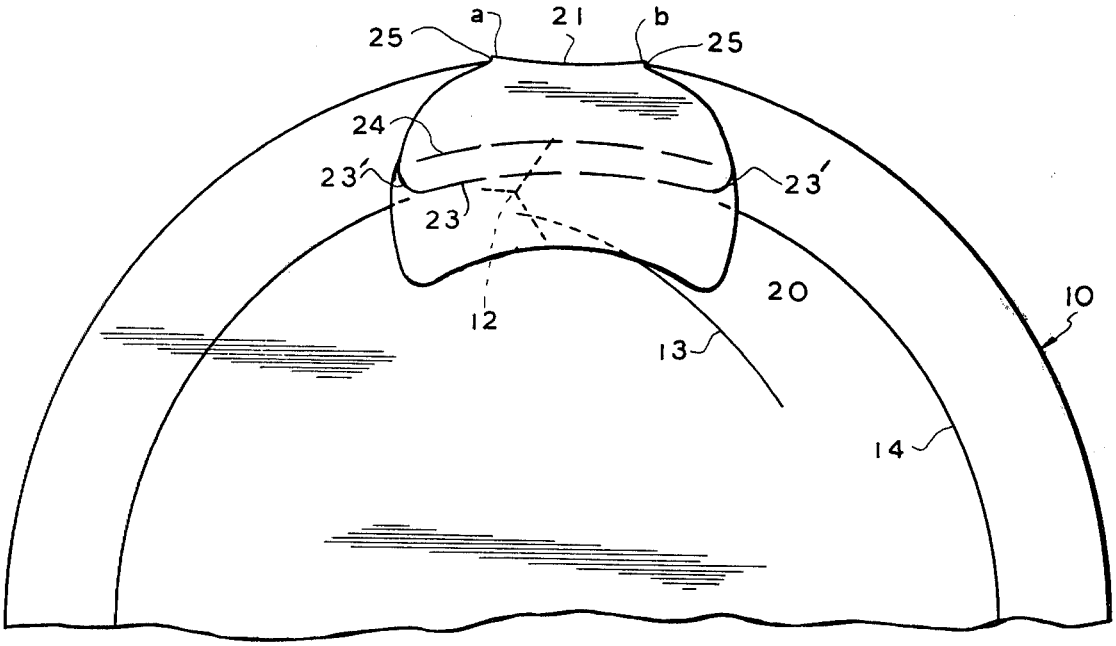
FIG. 6

FIG. 7
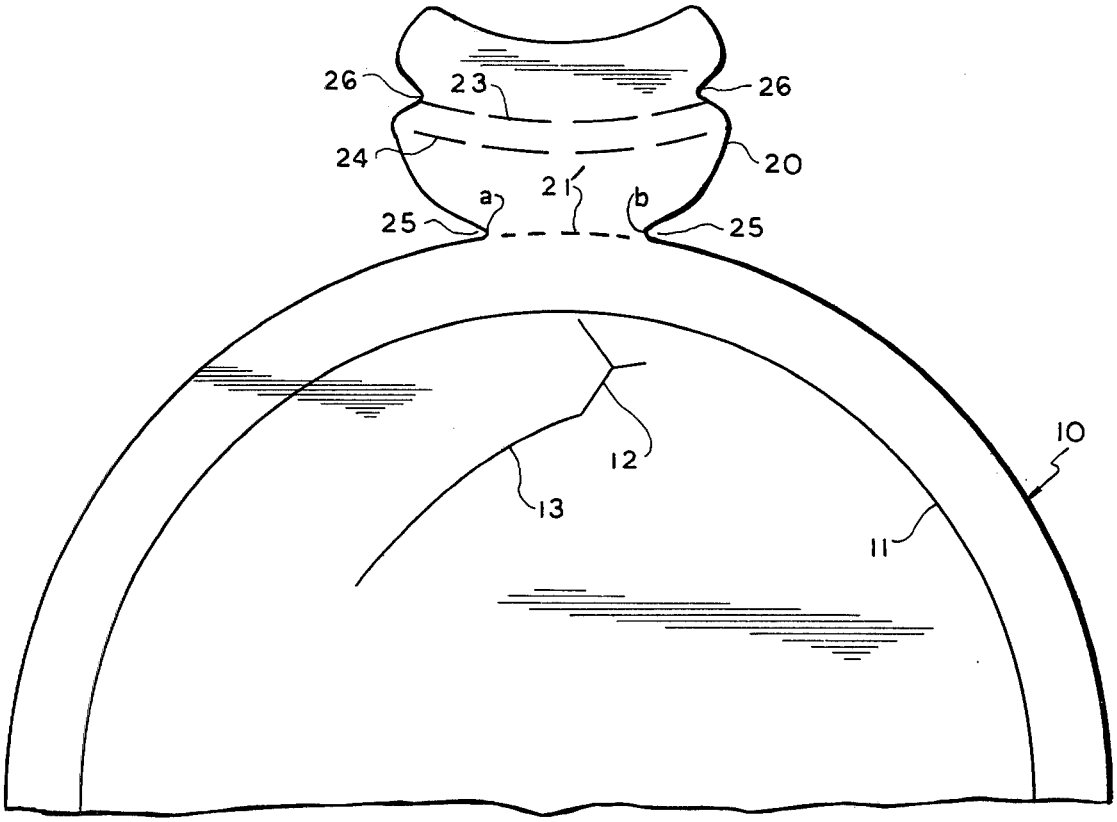
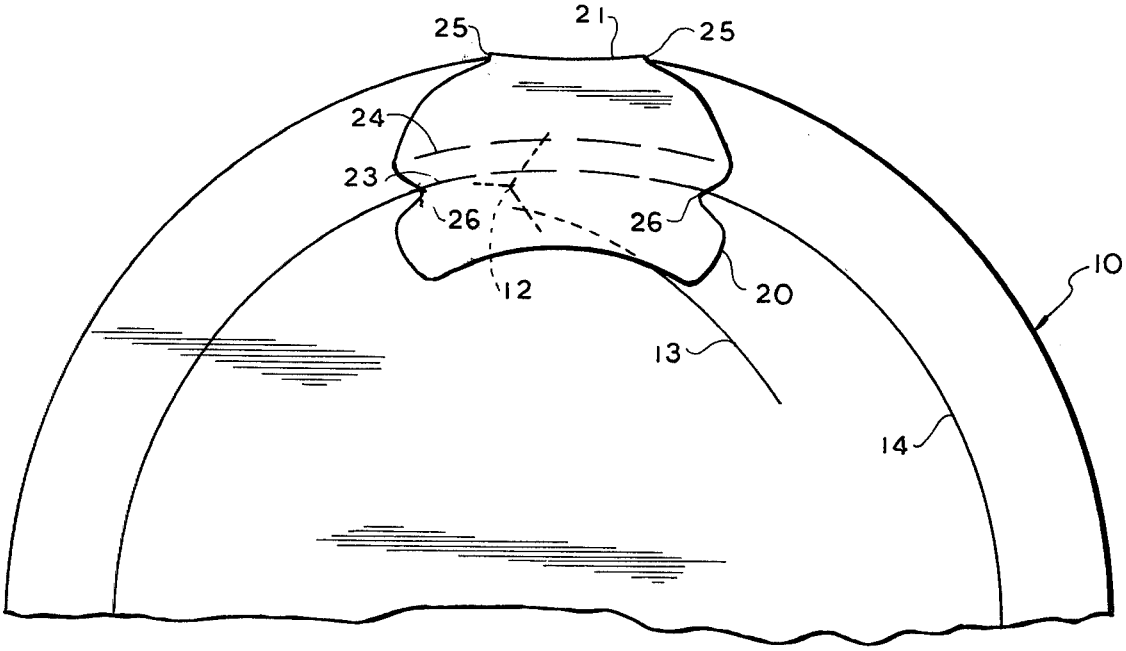
FIG. 8

OPENABLE CARDBOARD LID FOR EXTENDABLE POPCORN PANS

Cross-Reference to related Applications all assigned to the instant assignee:

| Serial No. | Status | Serial No. | Status |
|---|---|---|---|
| 963,155 | Abandoned | 971,953 | Allowed |
| 969,253 | U.S.P. D258,350 | 971,955 | Pending |
| 971,888 | Abandoned | 972,039 | U.S.P. 4,194,680 |
| 971,951 | pending | 972,040 | U.S.P. 4,194,681 |
| | | 972,510 | U.S.P. 4,211,360 |

BACKGROUND OF THE INVENTION

This invention relates generally to openable protective covers for prepacked foods, and more specifically it relates to a protective tab for an opening device provided in a protective lid used in connection with an extendable spun aluminum foil covering a pan containing prepacked popcorn. The protective covers of this type have been described in detail in the above-mentioned related patent applications. Generally, such prior-art covers include a circular cardboard lid covering the extendable spun aluminum foil which in turn covers the popcorn pan. An opening device formed in the lid includes circular score lines provided on both sides of the lid at a certain distance from the edge and an additional score with star-shaped angular through-cuts. The user before heating the pan first removes the major central part of the lid by bending the angular through-cuts to form a pulling tab which is grasped by fingers and tears-open the lid along the score lines. The ring-shaped narrow border portion of the lid remains attached to the edge of the pan while the large central area of the spun aluminum foil which during heating will expand, is exposed.

In order to protect the extendable spun aluminum covering against puncturing during the opening process, the angular pulling tab is backed by a foldable protective tab which is formed by stamping simultaneously with the cardboard lid and forms a satellite tab. Conventionally, this protective satellite tab has a substantially circular configuration whereby its top portion is cut away so as to form a semi-elliptical cutout and its base portion is integral with the circumference of the larger protective lid proper. Normally, this integral connection line is scored by interrupted cuts coinciding with the perimeter of the larger lid. Conventionally, the length of this base is about 1 5/16 of an inch. In addition, the satellite tab is provided with two semi-elliptical rows of cuts which upon folding the tab below the lid coincide with the two scored circles of the opening device in the lid.

The size and shape of the protective tab is such that when the tab is folded underneath the circular large lid it backs the angular cuts of the opening device thereby preventing the accidental puncturing of the spun aluminum foil covering the popcorn itself when the user bends the corners of the pulling tab by a knife, for example. When the internal part of the lid is removed by the opening device, the protective tab remains over the expandable aluminum foil and when the pan is subject to the heating-up process which activates the expansion of the spun aluminum covering, the protective tab rises together with the aluminum foil due to the pressure exerted by the heated vapors inside the pan. Experience has shown, however, that at some point the tab resists further expansion of the spun aluminum and is thus prone to puncture the foil bag thereby interfering with completion of the cooking cycle of the popcorn.

SUMMARY OF THE INVENTION

It is therefore a general object of the present invention to overcome the aforementioned disadvantage.

More particular, it is an object of the invention to provide an improved opening device for the protective cardboard lid covering the extendable spun aluminum foil extending over popcorn prepacked in an aluminum pan, which insures not only the trouble-free opening operation but also prevents any interference of the opening device with the expanding aluminum foil bag.

Another object of this invention is to provide an improved lid for the prepacked popcorn which upon opening of the lid, makes it possible that the protective tab remaining on the rim of the pan in contact with the extendable spun aluminum foil yields to the expansion of the latter when the pan is heated.

Still another object of this invention is to provide such an improved lid which can be easily attached to the rim of the aluminum popcorn pan.

In keeping with these objects, and others which will become apparent hereafter, one feature of the invention resides, in a popcorn lid having an opening device in the form of curved score lines arranged on the lid surface of and cooperating with an angular cut-through pulling tab, in a combination comprising a protective tab of a substantially semi-circular shape having a base line integral with a circumferential section of the lid, a cut-away top portion substantially semi-elliptical in shape, a row of through-cuts extending along the base line and two parallel rows of through-cuts extending substantially parallel to the cut-away top portion and being spaced from the lateral edges of the protective tab, and additional cuts in the protective tab provided between the lateral edges of the latter and at least one of the rows of through-cuts to facilitate the rising of the protective tab enforced by the expanding foil bag.

The additional cuts may be in the form of small arcuate cuts bridging the nicks between the lateral edges of the protective tab and the ends of one of the rows of through-cuts adjoining the semi-elliptical cut-away top portion.

In another embodiment, the additional cuts may include the first-mentioned arcuate cuts and further including additional V-shaped cut-away portions or notches in the lateral edges of the protective tap adjoining the base line so that this base line is reduced in length. The reduction of this base line is such that after folding of the tab it coincides substantially with the circumference of the lid.

In still another embodiment of this invention, the additional cuts include a pair of intermediate V-shaped notches cut out in the lateral edges of the protective tap in the range of the one row of through-cuts adjoining the semi-elliptical top portion.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWINGS

FIGS. 3 and 4 show respectively in top and bottom views a cut-away part of one embodiment of the lid of this invention;

FIGS. 5 and 6 show, respectively, top and bottom views of a cut-away portion of another embodiment of the lid of this invention; and FIGS. 7 and 8 show, respectively, in a top and bottom view a cut-away portion of still another embodiment of the lid of this invention.

DESCRIPTION OF THE PREFERRED EMBODIMENTS

Figure 1:
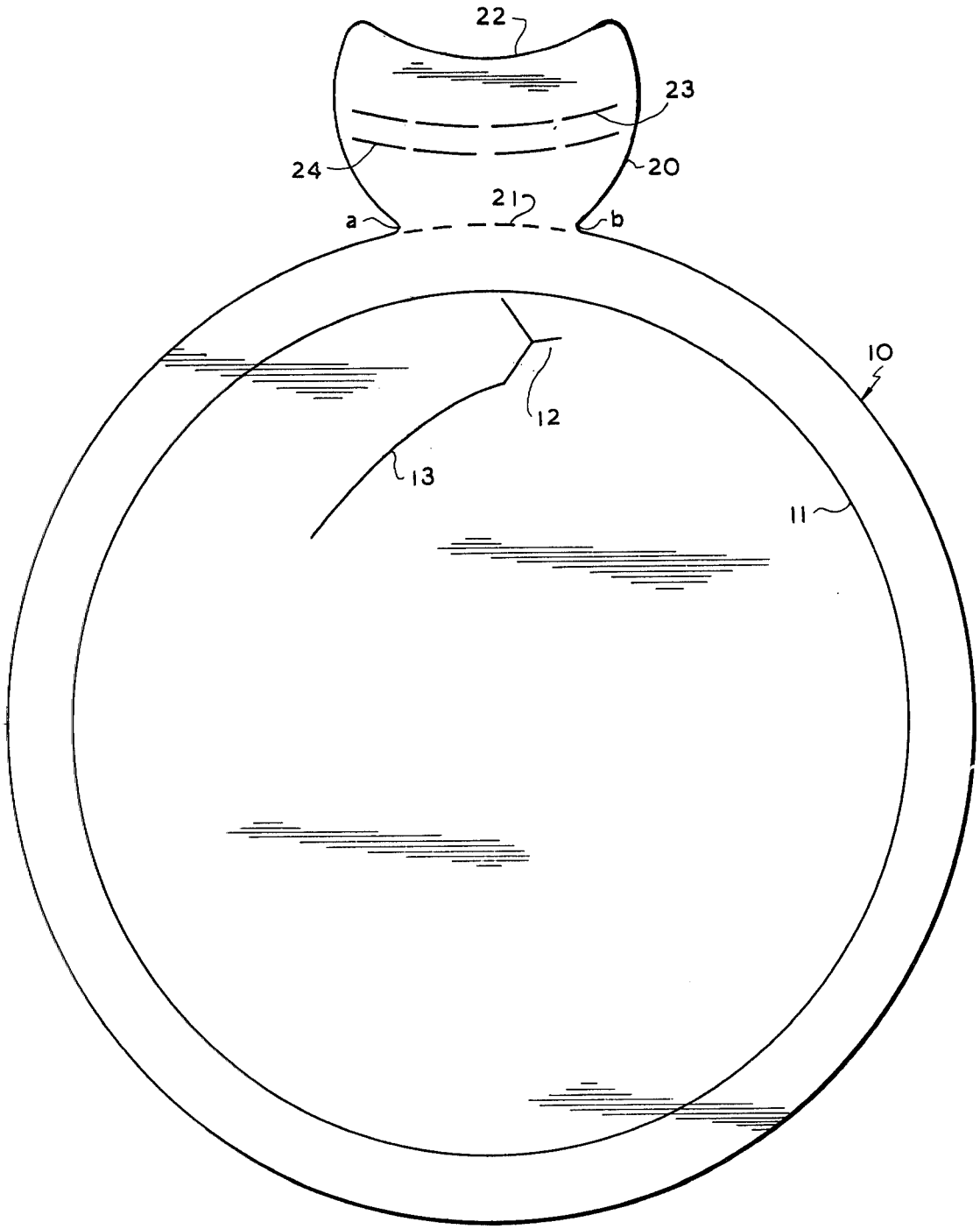
FIG. 1 PRIOR ART
FIG. 1 is a top view of prior art popcorn lid with unfolded protective tab.
Figure 2:
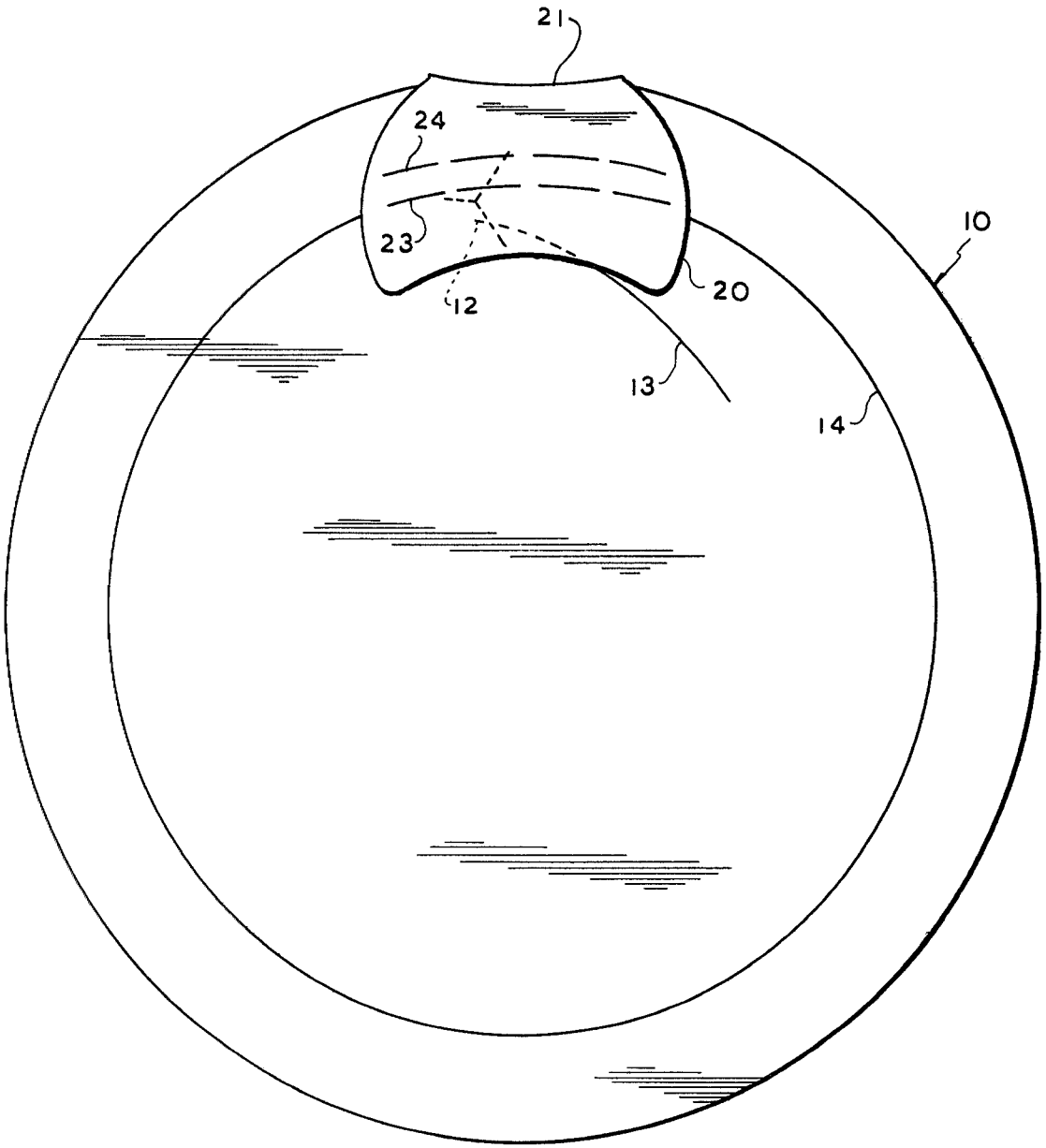
FIG. 2 PRIOR ART
FIG. 2 is a bottom view of the lid of FIG. 1 with folded tab.

FIGS. 1 and 2 illustrate a known popcorn lid 10 made preferably of cardboard which includes an opening device formed of two circular score lines 11 and 14 each being punched approximately half way through the thickness of the cardboard from opposite sides of the lid and being spaced a small distance from one another. There is also provided a short score line 13 converging toward the circular score line 11 and being terminated with a star-shaped angular cut 12 overlapping both the short score line 13 and the circular score line 11 to serve as a pulling tab when the opening operation of the lid is initiated. By pulling the angular tab 12 the major part of the lid is removed firstly along the score line 13 and the juxtaposed part of score line 11 and subsequently along the remaining part of the score lines 11 and 14. The annular border portion of the lid between the score line 11 and the perimeter of the lid remains attached to a non-illustrated aluminum pan containing the popcorn even after the large central part of the lid has been removed.

To protect the underlying spun foil of a thin aluminum (not shown) which expands during the heating of the popcorn, against accidental puncturing when the user starts exerting a pressure against the angular pull tab 12, a peripheral portion of the lid 10 opposite the angular cuts of pull tab 12 is integrally connected along a base line a-b with a semicircular protective tab 20. The top of tab 20 has a semi-elliptical cut-out edge 22 and, approximately midway between the upper cut-out edge 22 and the base line a-b is further provided with two rows of intermittent cuts 23 and 24 extending substantially parallel to the edge 22. An additional row of cuts 21 following the curvature of the circumference of the lid 10 is formed in the base line a-b of the protective tab 20. As can be seen from FIG. 2, the protective tab 20 is folded-over along the cut/nicked line 21 to abut against the bottom surface of the lid 10 in the region of the star-like angular pull tab 12. When the central major part of the lid is removed along the line 14, the tab 20 remains attached to the rim of the popcorn pan together with the annular border remaining between the lines 14 and the peripheral edge of the lid. When the underlying spun aluminum foil covering the popcorn starts expanding during the heating of the pan, the projecting part of the protective tab 20 is raised simultaneously with the rising foil bag. As has been mentioned above, in prior art lids it can happen that at some point the protective tab resists the expansion of the spun aluminum foil and punctures the same so that the roasting process of the popcorn cannot be properly completed.

The popcorn lids according to this invention as illustrated in FIGS. 3 to 8 eliminate the accidental puncturing of the aluminum foil. The parts of the lid of this invention corresponding to the prior art lid as shown in FIGS. 1 and 2 are designated by like reference numerals.

In the first example of this invention (FIGS. 3 and 4) there are provided two additional arcuate cuts 23' of about 1/16 inch radius extending in tandem with end cut lines of the upper row 23 and connecting, respectively, these end cut lines with the lateral edges of the protective tab. The lower row 24 of cut lines is left without change. As seen from FIG. 4, upon folding the protective tab 20 against the bottom of lid 10, the arcuate marginal cuts 23' provide for a streamlined transition of the upper cut-nicked line 23 to the edge of the annular remnant of the lid, thereby facilitating the upward bending of the projecting tab portion along the line 23 and reducing the resistance against the expanding aluminum foil.

A second example of this invention is illustrated in FIGS. 5 and 6. In addition to the previously described arcuate marginal cuts 23', the tab 20 is provided in the region of its base line a-b with cutout V-shaped notches 25 reducing the length of the base line to such an extent that upon folding-over the tab, the line 21' lies substantially parallel to the perimeter of the large lid 10. Before this reduction in length of the line a-b, the score line 21 had a tendency to protrude and when placed in contact with the pan rim it caused an improper fitting. The base notches 25 eliminate this drawback and contribute also to a smoother accommodation of the tab 20 to the movement of the expanding foil.

The embodiment of this invention shown in FIGS. 7 and 8 has in addition to base notches 25 two additional notches 26 cut out in the lateral edges of the protective tap 20 in the region of the upper cut-nicked line 23. The tips of the cut-out notches 26 communicate with the end cut lines of the upper row 23 so that during the expansion of the spun aluminum foil the projecting part of the protective tap 20 yields to the movement of the foil and eliminates any breakage thereof.

It will be understood that each of the elements described above, or two or more together, may also find a useful application in other types of constructions differing from the types described above.

While the invention has been illustrated and described as embodied in a popcorn cover, it is not intended to be limited to the details shown, since various modifications and structural changes may be made without departing in any way from the spirit of the present invention.

Without further analysis, the foregoing will so fully reveal the gist of the present invention that others can, be applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In an openable lid for use in connection with a popcorn pan covered with an expandable foil, said lid including an opening device in the form of curved score lines cooperating with an angular pulling tab, and a protective tab of a substantially semi-circular shape having a base line integral with a circumferential section of said lid, a cut-away top edge of a substantially semi-elliptical shape, a row of through-cuts extending along said base line, and two parallel rows of through-cuts extending substantially parallel to said cut-away top edge and being separated from the lateral edges of said protective tab, a combination comprising additional cuts in said protective tab extending between said lateral edges of the latter and at least one of said two rows of through-cuts to reduce the resistance of said protective tab against the expandable foil during expansion.

2. A combination as defined in claim 1, wherein said additional cuts further include lateral notches in the region of said base line to reduce the length of said base line to such an extent that it substantially coincides with a circumferential section of said lid.

3. The combination as defined in claim 1, wherein said additional cuts include substantially V-shaped notches cutout in the lateral edges of said protective tab in the region of said one row of through-cuts and communicating with the through-cuts of said one row.

* * * * *